United States Patent [19]

Mantani

[11] 4,189,971

[45] Feb. 26, 1980

[54] ELECTRONIC MUSICAL INSTRUMENT SYSTEM HAVING INDEPENDENT TONE CABINET

[75] Inventor: Rokurota Mantani, Hamamatsu, Japan

[73] Assignee: Nippon Gakki Seizo Kabushiki Kaisha, Hamamatsu, Japan

[21] Appl. No.: 890,418

[22] Filed: Mar. 27, 1978

[30] Foreign Application Priority Data

Apr. 4, 1977 [JP] Japan ..... 52-38220

[51] Int. Cl.[2] ..... G10H 1/04

[52] U.S. Cl. ..... 84/1.24; 84/1.25; 84/1.27; 84/DIG. 1; 84/DIG. 4

[58] Field of Search ..... 84/1.09, 1.1, 1.24, 84/1.25, 1.27, DIG. 1, DIG. 4, DIG. 19, DIG. 27

[56] References Cited

U.S. PATENT DOCUMENTS

| | | | |
|---|---|---|---|
| 3,288,908 | 11/1966 | Markowitz | 84/1.25 |
| 3,553,338 | 1/1971 | Holman | 84/1.24 X |
| 3,626,078 | 12/1971 | Sekiguchi | 84/1.24 |
| 3,647,928 | 3/1972 | Turner | 84/1.24 |
| 3,848,092 | 11/1974 | Shamma | 84/1.27 X |
| 3,897,709 | 8/1975 | Hiyoshi et al. | 84/1.24 X |
| 3,911,776 | 10/1975 | Beigel | 84/1.24 X |
| 3,919,911 | 11/1975 | Nakata et al. | 84/1.27 |
| 4,133,242 | 1/1979 | Nagai et al. | 84/1.24 X |
| 4,133,244 | 1/1979 | Hiyoshi et al. | 84/1.24 X |

*Primary Examiner*—S. J. Witkowski

*Attorney, Agent, or Firm*—Frishauf, Holtz, Goodman & Woodward

[57] ABSTRACT

An electronic musical instrument system comprising an electronic musical instrument body and a separate tone cabinet connected together by a cable. The electronic musical instrument body includes a plurality of tone coloring circuits to produce different musical tone signals, a musical tone signal selection circuit to select at least one of the output signals of these tone coloring circuits, and a musical effect selector; and the tone cabinet includes a musical effect imparting circuit to impart the selected musical tone signal or signals with a selected musical effect, a sound system having at least one loudspeaker connected to the musical effect imparting circuit, and a control circuit responsive to the musical effect selector for producing control signals to cause the musical effect imparting circuit to impart a selected musical effect to the selected musical tone signal or signals.

14 Claims, 10 Drawing Figures

ELECTRONIC ORGAN BODY
11
13
TONE CABINET
12

TONE GENERATORS
14
KEYBOARD CIRCUIT
15
TONE COLORING CKT (FLUTE)
16
TONE COLORING CKT (STRING)
17
18
VS11
VS12
VS21
VS22
"1"
"1"
MS
TS
FL
OR
CH
TR
TSC
PS
GND
CABLE 13 TO TONE CABINET
VC
VT
CHORUS
TREMOLO
TREMOLO SPEED CONTROL
19
ELECTRONIC ORGAN BODY 11
POWER SUPPLY
20
SW

ELECTRONIC MUSICAL INSTRUMENT SYSTEM HAVING INDEPENDENT TONE CABINET

BACKGROUND OF THE INVENTION

This invention relates to an electronic musical instrument system suitable for use in stage performance and having one or more tone cabinets which are provided separated from and independently of an instrument body having a keyboard section.

Electronic musical instruments into which a sound system having loudspeakers is built cannot produce a satisfactory sound effect when played on a stage or the like. Therefore, it has hitherto been the practice to provide one or more tone cabinets including loudspeakers independently of the musical instrument body having a keyboard.

More particularly, one or more tone cabinets, which include loudspeakers such as woofer, scocer and tweeter, are provided separately from the instrument body having a playing section such as a keyboard and are connected to the instrument body by conducting means such as connection wires. In such an electronic musical instrument system of independent tone cabinet type, a musical tone selection means for selecting musical tone signals is provided in the instrument body, while a musical effect imparting means for imparting the musical tone signals with a musical effect such as tremolo or the like is provided within each tone cabinet. Therefore, when the musical effect to be imparted to a musical tone signal is modified in accordance with the selected musical tone signal, it is necessary for the player to leave the instrument body and go to the tone cabinet to adjust the musical effect imparting means. This imposes a great restriction upon the stage performance of an electronic musical instrument.

SUMMARY OF THE INVENTION

An object of the invention is to provide an electronic musical instrument system in which the control of a musical effect applied to a musical tone signal in a tone cabinet section can be effectively made concurrently with the tone color control at a musical instrument body having a keyboard section.

According to this invention there is provided an electronic musical instrument system comprising an instrument body and a separate remote tone cabinet connected to the instrument body by, for example, a cable. The instrument body includes a plurality of tone coloring circuits connected to receive a tone signal for producing a plurality of differently tone-colored musical tone signals, musical tone signal selection means connected to the tone coloring circuits for selecting and providing at least one of said plural musical tone signals to one output terminal, and musical effect selection means ganged with the musical tone signal selection means to select one of a plurality of musical effects to be given to the musical tone signal or signals selected by the musical tone signal selection means. The remotely located tone cabinet includes musical effect imparting circuit means for imparting a selected musical effect to the selected musical tone signal or signals, control means responsive to the musical effect selection means of the instrument body to set said musical effect imparting circuit means into a state for imparting the musical effect selected by the musical effect selection means to the selected musical tone signal or signals, and a sound system having at least one loudspeaker and coupled to the output of the musical effect imparting circuit means.

DESCRIPTION OF THE PREFERRED EMBODIMENT

Figures 1, 2:
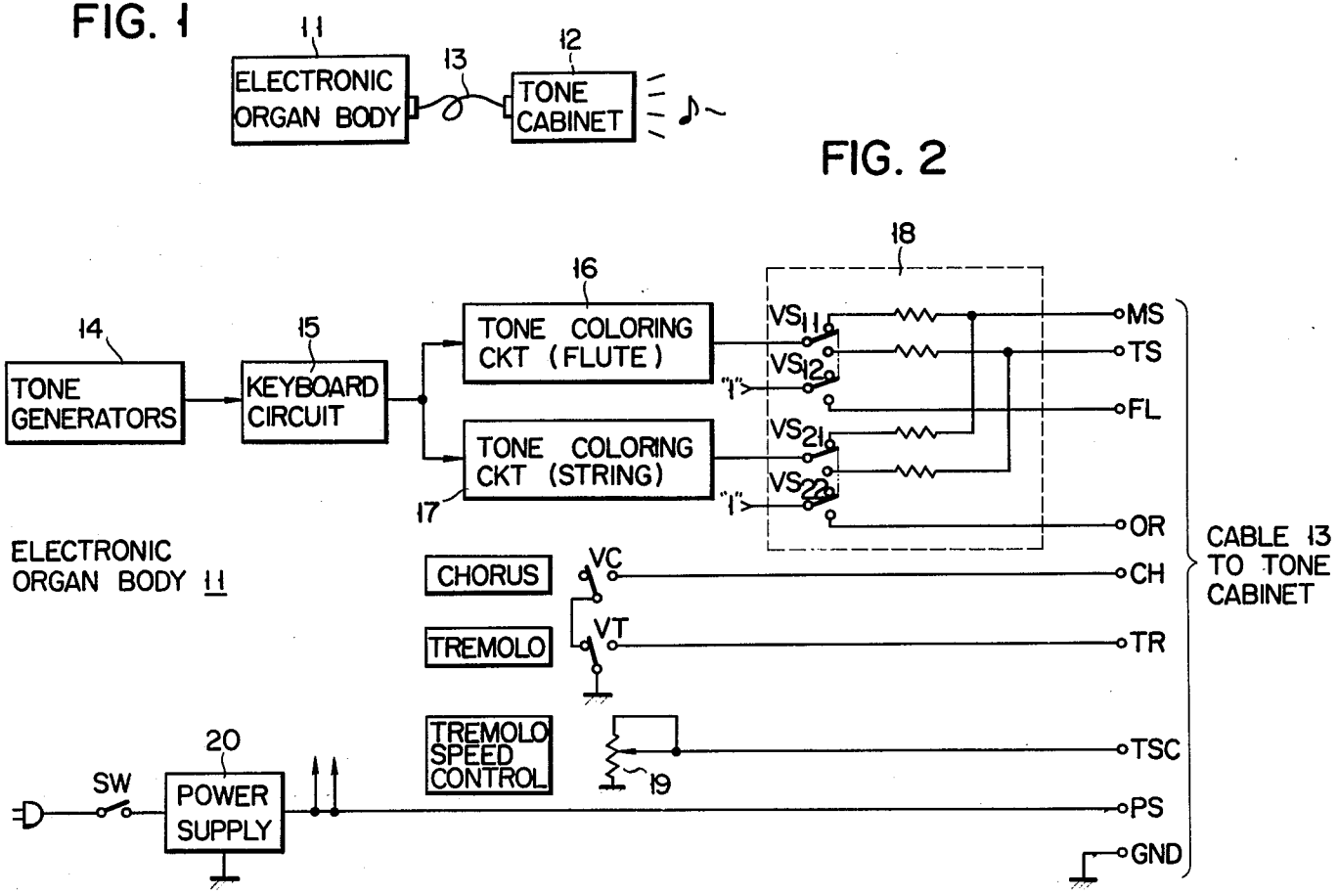
FIG. 1 is a diagram for explaining the invention.
FIG. 2 shows a schematic construction of an electronic organ body according to one embodiment of the invention.

The invention will now be described in conjunction with an embodiment thereof with reference to the accompanying drawings. As shown in FIG. 1, an electronic musical instrument system according to the invention comprises an electronic organ body 11 and a separately provided tone cabinet 12 for sounding musical tones. The instrument body 11 and tone cabinet 12 are connected together by a cable 13 including a plurality of connection leads. For stage performance, for instance, the tone cabinet 12 is disposed at a most suitable position from the standpoint of the performance effects.

FIG. 2 shows the construction of the electronic organ body 11. Designated at 14 are tone generators, and at 15 a keyboard circuit which is controlled by operating a keyboard provided on the body 11. A tone signal corresponding to the note of each operated key is taken out by the keyboard circuit 15, and then coupled to both first and second tone coloring circuits 16 and 17. The first tone coloring circuit 16 produces a musical tone signal having a tone color like a flute and the second tone coloring circuit 17 produces a musical tone signal having a tone color like a string. The musical tone signals of flute and string, obtained from the respective first and second tone coloring circuits 16 and 17, are coupled to respective movable contacts of single-pole double-throw switches VS11 and VS21 constituting a musical tone signal selection circuit 18. These switches VS11 and VS21 each have one fixed contact connected through a resistor to an output terminal MS and another fixed contact connected through a resistor to another output terminal TS of the musical tone signal selection circuit 18.

Instruction switches VS12 and VS22 ganged with the respective switches VS11 and VS21 are provided. When the movable contacts of switches VS11 and VS21 are thrown to the side of the output terminal TS, the switches VS12 and VS22 provide an instruction signal of logic level "1" to respective output terminals FL and OR.

In addition to the musical tone signal selection circuit, the body 11 is further provided with single-pole double-throw switches VC and VT for selecting such musical effects as chorus and tremolo. These switches constitute a musical effect selection circuit with preference to tremolo, with the movable contact of the switch VC connected to the normally closed fixed contact of the switch VT and the movable contact of the switch VT connected to ground. The normally open fixed contacts of the switches VC and VT are connected to respective output terminals CH and TR, and a logic signal "0" or ground potential is given to the terminal CH or TR when a chorus or tremolo selection switch is operated.

The speed of tremolo is set by a tremolo speed control circuit 19 comprised of a variable resistor, and the tremolo speed specifying information is taken out from an output terminal TSC.

Further, the body 11 is provided with a power supply 20, which is connected to an external commercial power source by a power switch SW. The output of the power supply 20 is supplied to the circuit section of the body, and also it is coupled to an output terminal PS. GND is a grounded terminal.

Figure 3:
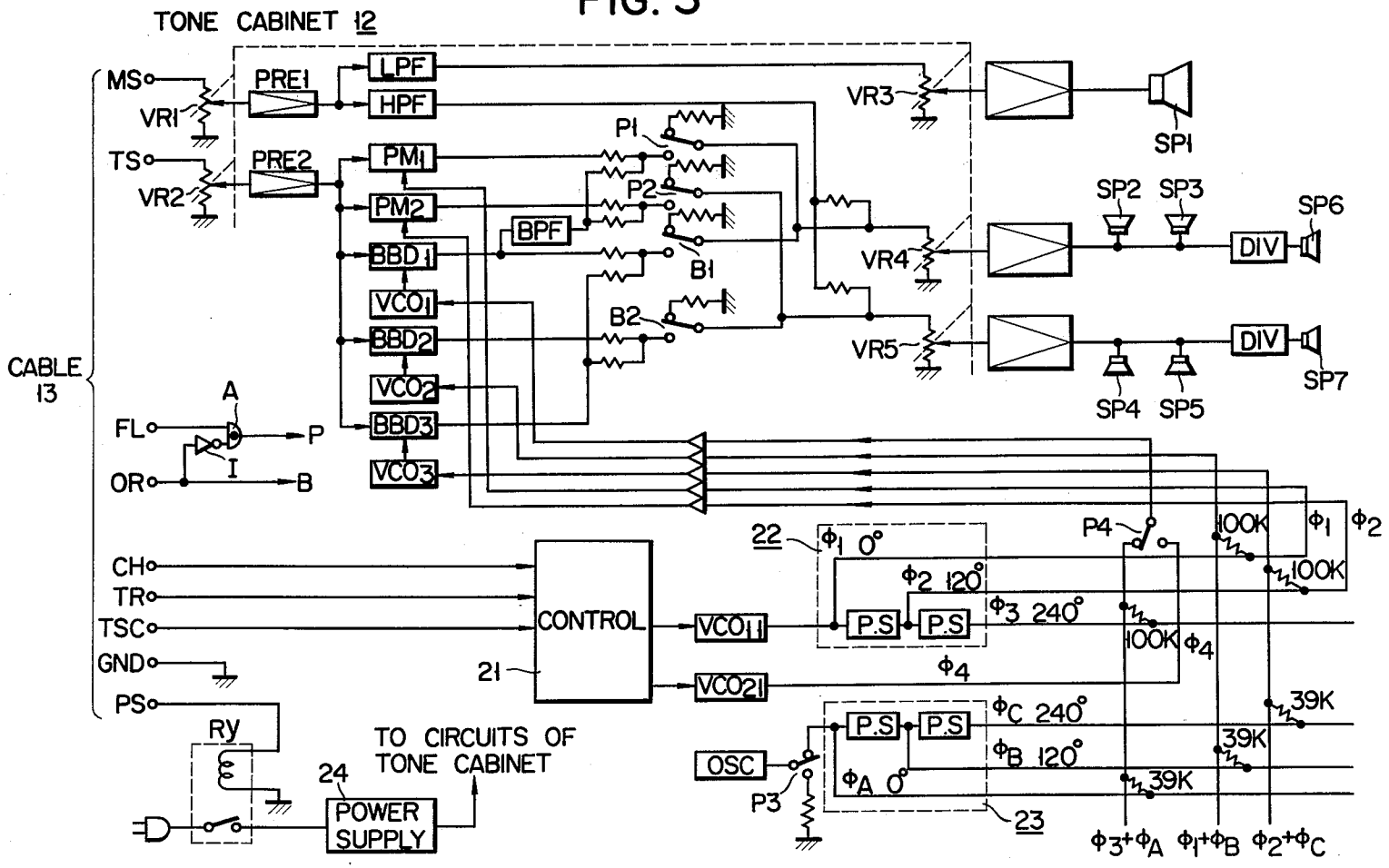
FIG. 3 shows a schematic construction of a tone cabinet according to one embodiment of the invention.
Figure 4:
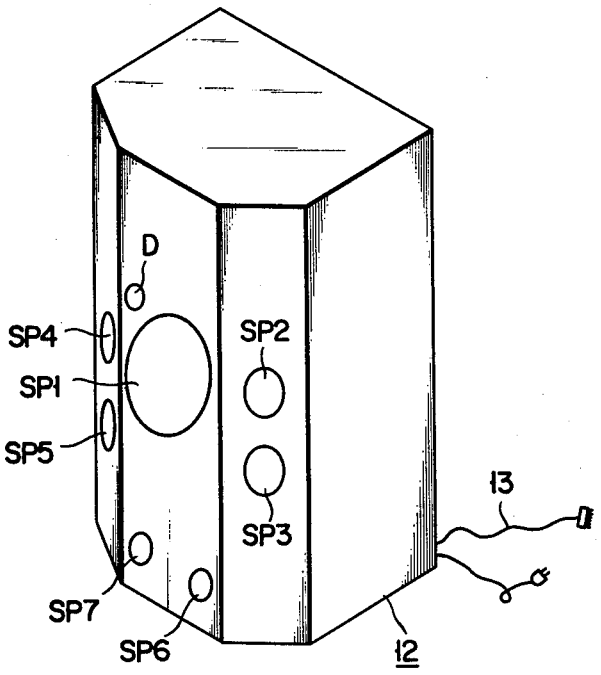
FIG. 4 is a perspective view of the tone cabinet.

The output terminals MS, TS, FL, OR, CH, TR, TSC, PS and GND in the body 11 are connected by respective leads constituting the cable 13 to corresponding terminals provided in the tone cabinet 12, as shown in FIG. 3. The cabinet 12 has an appearance as shown in FIG. 4, provided with a low-range loudspeaker or woofer SP1, four mid-range loudspeakers or scocers SP2 to SP5, two high-range loudspeakers or tweeters SP6 and SP7 and also a bass-reflux port or duct D.

In the tone cabinet 12, musical tone signals coupled to the terminals MS and TS are applied through the level controllers VR1 and VR2 consisting of variable resistors to preamplifiers PRE1 and PRE2, respectively. The musical tone signal from the preamplifier PRE1 is supplied to both lowpass filter LPF and highpass filter HPF. The low-range musical tone signal from the lowpass filter LPF is coupled through a level controller VR3 and an amplifier to the woofer SP1. The high-range musical tone signal from the highpass filter HPF is coupled to level controllers VR4 and VR5 in the same proportion, and the two-channel musical tone signals from the level controllers VR4 and VR5 are coupled to respective two-channel scocers SP2, SP3, and SP4, SP5 and also coupled through dividing networks DIV to the respective tweeters SP6 and SP7.

The musical tone signals from the preamplifier PRE2 are coupled to first and second phase modulators PM1 and PM2 and first to third delay-time modulators BBD1 to BBD3. The output signals from the phase modulators PM1 and PM2 are coupled through respective switches P1 and P2 to the respective level controllers VR4 and VR5, and the output signals from the delay-time modulators BBD1 and BBD2 are coupled through respective switches B1 and B2 to the respective level controllers VR4 and VR5.

The signals FL and OR that are obtained from the musical tone signal selection circuit 18 are applied to the corresponding terminals FL and OR in the tone cabinet 12. The signal FL is coupled to one input of an AND gate A, the other input of which is coupled to the output of an inverter I which receives the signal OR. A command signal B is obtained from the signal OR. The switch groups P1, P2; and B1, B2 are operated by the corresponding signals P and B. These switches P1, P2, B1 and B2 are normally in the illustrated state in the absence of the signals P and B, and they are each constituted by an electronic switch or relay.

The output signal from the first delay-time modulator BBD1 is coupled through a bandpass filter BPF to the selection switches P1 and P2 in the same proportion, and the output signal from the third delay-time modulator BBD 3 is coupled also to the selection switches B1 and B2 in the same proportion.

The delay-time modulators BBD1 to BBD3 are each constructed by, for instance, a bucket-brigade device, and adapted to transmit an input signal under the control of a clock pulse signal. The delay time or transmission time of the input signal from the input to the output is determined by the oscillating frequency or shift clock frequency of respective voltage-controlled frequency variable oscillators VCO1 to VCO3. By applying a modulation signal to the individual oscillators VCO1 to VCO3, the delay time or transmission time of the musical tone signal is modulated. The modulators PM1, PM2 and BBD1 to BBD3 constitute a musical effect imparting circuit for imparting various musical effects to the musical tone signal. The phase modulators PM1 and PM2 and delay-time modulator BBD1 constitute a first musical effect circuit, which is adapted to impart musical effects particularly to the flute-musical tone signal, and the delay-time modulators BBD1 to BBD3 constitute a second musical effect circuit, which is adapted to impart musical effects particularly to the string-musical tone signal.

The musical effect imparting circuit is controlled by the chorus specifying instruction CH, tremolo specifying instruction TR and tremolo speed specifying instruction TSC, these instructions being delivered from the afore-mentioned instrument body 11. These signals CH, TR and TSC are coupled to a control circuit 21. The control circuit 21 controls the oscillation of frequency variable sinusoidal oscillators VCO11 and VCO12. For example, when the chorus specifying instruction CH is provided, the oscillation frequency of the oscillators VCO11 and VCO12 are set to 0.6 Hz, and in the case of delivery of the tremolo specifying instruction TR the frequency of the oscillator VCO11 is set to 6.4 Hz while setting that of the oscillator VCO21 to 12.8 Hz which is two times that of VCO11. Further, the frequencies of the oscillators VCO11 and VCO21 are altered by the tremolo speed control information. The phases of the signals of the oscillators VCO11 and VCO12 are independent of each other.

The signal from the oscillator VCO11 is supplied to a first phase shifter circuit 22, which includes, for instance, two phase shifter circuits PS and is adapted to produce signals $\phi_1$, $\phi_2$ and $\phi_3$ with respective phases of 0 degree, 120 degrees and 240 degrees relative to one another. The signals $\phi_1$ and $\phi_2$ which are 120 degrees out of phase are coupled as modulation signals through suitable buffer amplifiers to the phase modulators PM1 and PM2, respectively. The signal from the oscillator VCO21 is used as a modulation signal $\phi_4$.

As a further modulating signal generating circuit, an oscillator OSC which oscillates at, for instance, 0.6 Hz, is provided. The signal from this oscillator OSC is taken out through a switch P3, which is driven in the presence of the afore-mentioned control signal P, and is supplied to a second phase shifter 23. This phase shifter 23 includes two phase shifters PS and is adapted to produce signals $\phi_A$, $\phi_B$ and $\phi_C$ with respective phases of 0 degree, 120 degrees and 240 degrees. These signals $\phi_A$, $\phi_B$ and $\phi_C$ are suitably combined with the respective signals $\phi_1$, $\phi_2$ and $\phi_3$ in a matrix circuit. The matrixed signal $\phi_3+\phi_A$ and the signal $\phi_4$ are selected by a switch P4 which is driven by the control signal P and used as modulation signal for the BBD1. In the absence of the signal P, the signal $\phi_3+\phi_A$ is selected as modulation signal. The signals $\phi_1+\phi_B$ and $\phi_2+\phi_C$ are used as modulation signals for the respective delay-time modulators BBD2 and BBD3.

The terminal GND is grounded to provide for common grounded point for both body 11 and cabinet 12. The power supply signal PS is adapted to drive a relay RY for controlling a power source circuit 24 within the tone cabinet 12.

In the instrument body 11 of the electronic musical instrument system of the above construction, when the switches VS11 and VS21 are in the illustrated state, the musical tone signals from the tone coloring circuits 16 and 17 appear at the terminal MS. A musical tone signal appearing at the terminal MS is led to the sound system in the tone cabinet 12 and directly sounded without any musical effect added. On the other hand, a signal appearing at the terminal TS is led, after addition of a musical effect of phase or delay-time modulation, to the sound system, and signals of flute and/or string, which do not appear at the terminal MS, appear at the terminal TS in accordance with the states of the switches VS11 and VS21.

The terminal FL becomes level "1" when the flute-musical tone signal from the tone coloring circuit 16 appears at the terminal TS. The terminal OR becomes level "1" when the musical tone signal output of the tone coloring circuit 17 appears at the terminal TS.

Further, when the chorus effect alone is specified in the body 11, the terminal CH is grounded to provide the chorus specifying information to the control circuit 21, and in the case of specifying tremolo the terminal TR is grounded to couple the tremolo specifying instruction to the control circuit 21. In either of these cases, the oscillators VCO11 and VCO12 are set to the frequencies suitable for provision of the chorus or tremolo effect. In particular, in case of specifying tremolo the tremolo speed, that is, the aforementioned oscillation frequency, can be controlled to some extent by a signal from the terminal TSC.

In this electronic musical instrument system, when the power switch SW in the instrument body 11 is closed, the power supply circuits 20 and 24 in the body 11 and tone cabinet 12 respectively are rendered into operative state.

At this time, if the selection switches VS11 and VS21 of the musical tone signal selection circuit 18 are both in the illustrated state, musical tone signals appear only at the terminal MS as mentioned above. Thus, in this case the musical tone signals are directly coupled to the sound system in the tone cabinet 12 and sounded without any additional musical effect.

When the switches VS11 and VS12 are switched from the above state, the musical tone signal from the tone coloring circuit 16 appears at the terminal TS, and the output of the other tone coloring circuit 17 appears at the terminal MS. At the same time, the level "1" signal appears at the terminal FL.

In this case, although a string-musical tone signal appearing at the terminal MS is directly led to the loudspeakers without addition of any particular musical effect, flute-musical tone signal is led to the musical effect imparting circuit section. Since in this case only the terminal FL is made at the level "1" signal, the switches P1 to P4 in the tone cabinet 12 are switched from the illustrated state. Thus, the flute-tone signals are led through the phase modulators PM1 and PM2 and delay-time modulator BBD1 to the sound system.

The phase modulators PM1 and PM2 are controlled by the modulation signals $\phi_1$ and $\phi_2$ which are of the same frequency but 120 degrees out of phase with each other. The delay-time modulator BBD1 is controlled by the signal $\phi_4$ from the separate oscillator VCO21. The two-channel musical tone signals phase-modulated by 120 degrees out of phase modulation signals are combined with the delay-time-modulated musical tone signal from the BBD1 and sounded from the respective channels in the sound systems, so that it is possible to obtain a musical effect similar to that is obtainable by a rotary loudspeaker system and known as "Leslie effect".

When the chorus effect is specified by the switch VC in the body 11 the modulation frequency for both modulations is set to 0.6 Hz. On the other hand, when specifying the tremolo effect by the switch VT the phase-modulation frequency is 6.4 Hz, and the delay-time-modulation frequency is double the phase-modulation frequency, that is, 12.8 Hz. Thus, it is possible to obtain a very excellent chorus or tremolo effect.

When the switches VS21 and VS22 are switched from the state of FIG. 2, string-musical tone signal containing many harmonics, produced from the tone coloring circuit 17, are obtained at the terminal TS, and at the same time the signal at the terminal OR becomes "1". In other words, the signal B is produced on the side of the tone cabinet 12 to switch the switches B1 and B2. Thus, the string-musical tone signal appearing at the terminal TS is supplied through the delay-time modulators BBD1 and BBD2 to the two-channel sound systems, and also output signal from the delay-time modulator BBD3 is supplied to the two-channel sound systems in the same proportion.

The modulators BBD1 to BBD3 function to transmit musical tone signals supplied thereto under the control of shift clock signals from the respective variable frequency sinusoidal oscillators VCO1 to VCO3. Their delay times in transmission of the musical tone signals are modulated according to the changes of clock frequencies of the oscillators VCO1 to VCO3, thereby imparting a musical effect to the musical tone signals. The oscillation frequencies of the individual oscillators VCO1 to VCO3 are controlled by respective differently phased signals, namely $\phi_A+\phi_3$, $\phi_B+\phi_1$ and $\phi_C+\phi_2$.

It will be understood that two string-musical tones delay-time-modulated with different modulation phases are sounded respectively in the first sound channel comprising the scocers SP2 and SP3 and tweeter SP6 and in the second sound channel comprising the scocers SP4 and SP5 and tweeter SP7, and at the same time the flute-musical tone from the tone coloring circuit 16 is sounded by the woofer SP1 without receiving any particular musical effect and also sounded by the aforesaid first and second sound channels.

Assuming now the case when the switches VS11, VS12, VS21 and VS22 are all switched from the state of FIG. 2, all the musical tone signals obtained from the tone coloring circuits 16 and 17 are coupled to the terminal TS, and no musical tone signal appears at the terminal MS. At the same time, level "1" signal appears at both the terminals FL and OR, and thus the signal B is produced in the tone cabinet 12 for switching the switches B1 and B2. This state is similar to the state that is obtained when only the switches VS21 and VS22 are switched. In this case that all switches are operated, delay-time modulation is provided to all of the flute- and string-musical tone signals, so that all the musical tones are given a musical effect similar to that obtainable by rotary loudspeakers. Thus, the chorus or tremolo effect is expressed very intensively.

Figure 5:
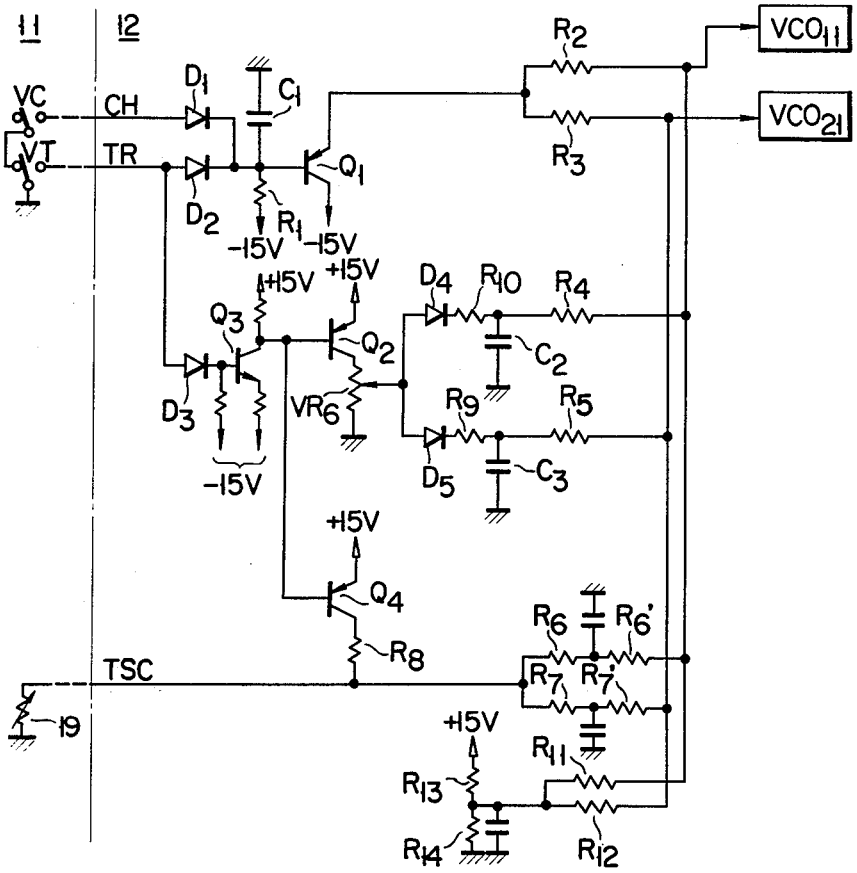
FIG. 5 is a circuit arrangement of the control circuit of FIG. 3.

FIG. 5 shows a specific example of the control circuit 21, which is provided in the tone cabinet 12 to receive the chorus, tremolo and tremolo speed control signals CH, TR and TSC and control the sinusoidal oscillators VCO11 and VCO12 for producing modulation signals. The signal CH from the switch VC is detected through a diode D1, and the signal TR from the switch VT is detected through diodes D2 and D3.

When the switches VC and VT are both in the illustrated state, that is, in the absence of the signals CH and TR, the base potential of a transistor Q1 is at −15 V. In this case, the transistor Q1 is in the conduction state to provide a deep negative potential to the oscillators VCO11 and VCO21 through respective resistors R2 and R3. Thus, the oscillators VCO11 and VCO12 will not oscillate, so that no musical effect is imparted to musical tones.

When the switch VC is closed, the signal CH is provided to give ground potential through the diode D1 to the base of the transistor Q1, thus turning the transistor Q1 into the non-conduction state. At this time, the transistors Q2 and Q4 are also rendered into non-conduction state, so that a voltage from a voltage divider consisting of resistors R13 and R14 is coupled as an oscillation drive signal to the oscillators VCO11 and VCO21 through respective resistors R11 and R12, thus causing the oscillation of the oscillators VCO11 and VCO21 both at 0.6 Hz.

Further, when the switch VT is closed, the signal TR is produced. In the presence of the signal TR ground potential is given to the base of the transistor Q1 through the diode D2 to turn the transistor Q1 into the non-conduction state. In this case, however, a transistor Q3 is turned conductive by the circuit of the diode D3, and also the transistors Q2 and Q4 are turned conductive. In this state, a voltage determined by a variable resistor VR6 in the collector circuit of the transistor Q2 and also a voltage determined by the tremolo speed control resistor 19 and a collector resistor R8 of the transistor Q4 are coupled, in addition to the voltage from the voltage divider of the resistor R13 and R14, to the oscillators VCO11 and VCO12 to produce modulation signals for the tremolo effect.

In this case, the oscillator VCO11 is set to a frequency in a frequency range centered at 6.4 Hz by a voltage determined by the variable resistor VR6 and applied through resistors R10 and R4 to the VCO11 as well as a voltage determined by the tremolo speed control resistor 19 and applied through resistors R6 and R6′ to the VCO11. The oscillator VCO21 is set to a frequency in a frequency range centered at 12.8 Hz by the voltage determined by the variable resistor VR6 and applied through resistors R9 and R5 to the VCO21 as well as the voltage determined by the tremolo speed control resistor 19 and applied through resistors R7 and R7′ to the VCO21. These oscillation frequencies of VCO11 and VCO21 are controllable by the tremolo speed control resistor 19.

Since the resistor R10 and resistor R9 constitute respective time constant circuits together with respective capacitors C2 and C3, when the transistor $Q_2$ is switched into the conduction state the voltage signal obtained from the variable resistor VR6 are supplied in a state rising at a time constant to the oscillators VCO11 and VCO21, whereby the oscillation frequency is slowly elevated to a predetermined tremolo frequency. This is effective for obtaining a musical effect similar to the variable speed control of the rotary loudspeaker system.

Figure 6:
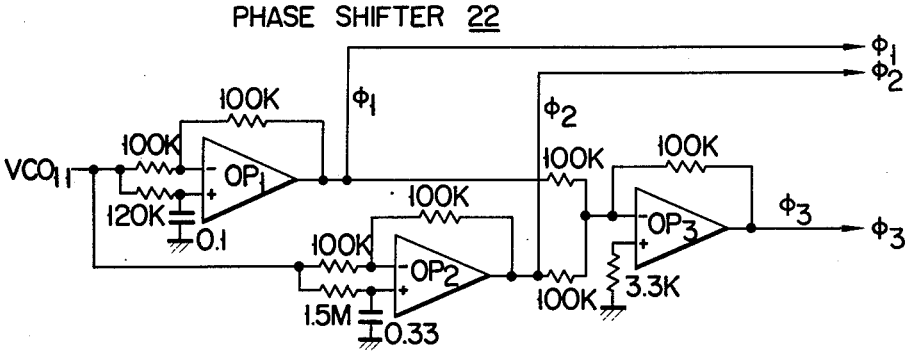
FIGS. 6 and 7 show other examples of the phase shifters of FIG. 3.

FIG. 6 shows an example of the phase shifter 22. Here, operational amplifiers OP1 and OP2 function to convert respective input signals into corresponding signals $\phi_1$ and $\phi_2$ 120 degrees out of phase with each other, and an operational amplifier OP3 serves to add the signals $\phi_1$ and $\phi_2$ and invert the sum to produce the signal $\phi_3$ with a phase difference of 120 degrees with respect to the signals $\phi_1$ and $\phi_2$.

Figure 7:
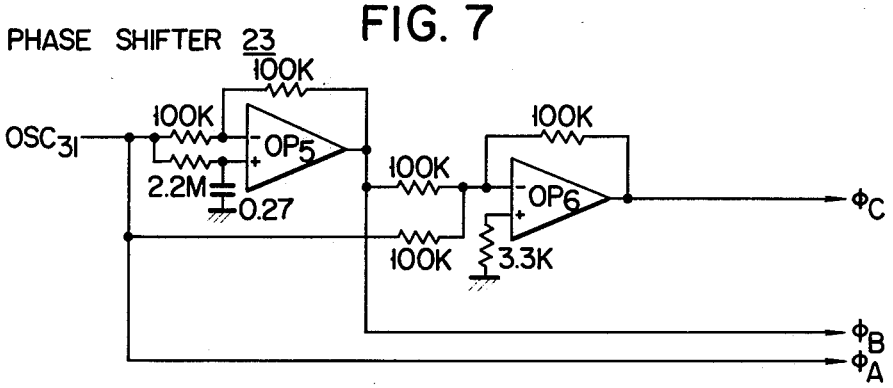

FIG. 7 shows an example of the phase shifter 23. Operational amplifiers OP5 and OP6 serve to 120-degree phase-shift respective input signals, thus producing the signals $\phi_A$, $\phi_B$ and $\phi_C$ differing in phase by 120 degrees with respect to one another.

Figure 8:
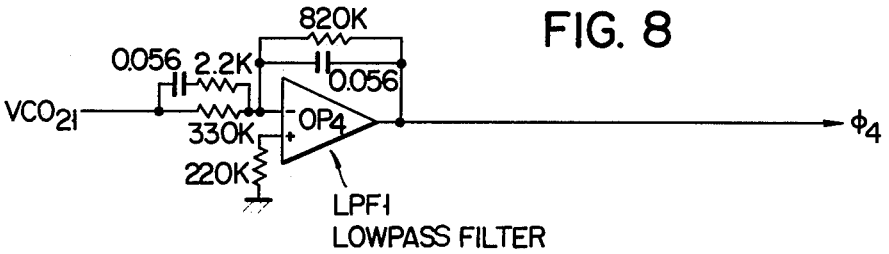
FIG. 8 is a modification of part of the tone cabinet shown in FIG. 3.

Further, in the system shown in FIG. 3 a lowpass filter LPF1, as shown in FIG. 8 for instance, may be provided on the output side of the oscillator VCO21 for producing modulation signal. While the oscillation frequency of the oscillator VCO21 is set to 0.6 Hz for chorus effect and to 12.8 Hz for tremolo effect, with the provision of the lowpass filter circuit to take out the output of the oscillator 21 for use as a modulation signal $\phi_4$ it is possible to provide different levels of the signal $\phi_4$ for the chorus and tremolo effects respectively. Thus, the modulation degree can be reduced when the modulation frequency is high or vice versa, thus permitting very excellent control of the expression of the musical effect.

Figure 9:
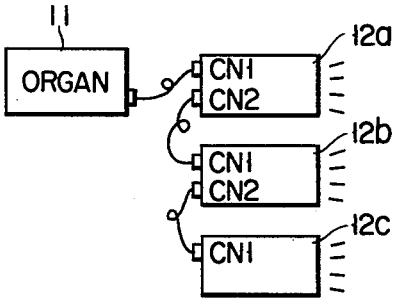
FIG. 9 is an electronic musical instrument system having a plurality of tone cabinets.
Figure 10:
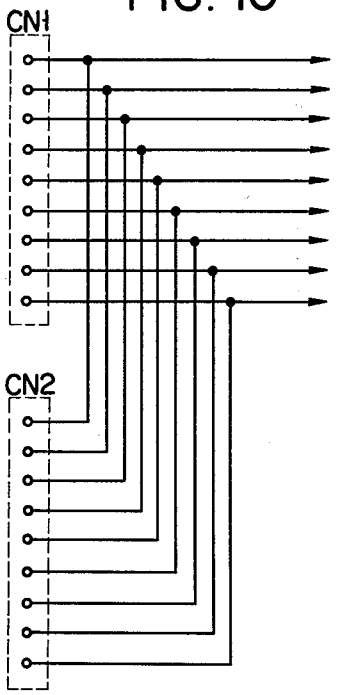
FIG. 10 shows a connection diagram of the terminal section of the tone cabinets in FIG. 10.

Furthermore, while the above description was concerned with the case of providing a single tone cabinet 12 for the electronic musical instrument body 11, a plurality of tone cabinets may be used. In such a case, a plurality of tone cabinets 12*a*, 12*b*, . . . having input and output connectors may be connected as shown in FIG. 9, with the output connector CN2 of one cabinet connected to the input connector CN1 of the next. In each tone cabinet, terminals of the input connector CN1 are connected to the corresponding terminals of the output connector CN2. See FIG. 10. This means that the plurality of tone cabinets 12*a* and 12*b* are connected in parallel to one another when viewed from the instrument body 11.

What is claimed is:

1. An electronic musical system comprising:

an instrument body;

at least one tone cabinet located remote from said instrument body and being separated therefrom; and means for electrically connecting said instrument body to said at least one tone cabinet;

said instrument body including:

a playing section;

a plurality of tone coloring circuits connected to receive a tone signal for producing a plurality of differently tone-colored musical tone signals;

musical tone signal selection means coupled to said tone coloring circuits for selecting and providing at least one of said plural musical tone signals to one output terminal; and musical effect selection means ganged with said musical tone signal selection means for selecting one of a plurality of musical effects to be given to the musical tone signal or signals selected by said musical tone signal selection means in accordance with the at least one tone color selected by said musical tone signal selection means; said at least one tone cabinet including:

musical effect imparting circuit means having an input for receiving said selected tone signal or signals and including tone signal modulating means for modulating said selected tone signal or signals in accordance with at least one modulation signal for imparting a selected musical effect or effects to said selected tone signal or signals;

control means coupled to and responsive to said musical effect selection means of said instrument body to set said musical effect imparting circuit means into a state for imparting the musical effect selected by said musical effect selection means to said selected tone signal or signals; and a sound system having at least one loudspeaker and having an input coupled to the output of said musical effect imparting circuit means.

2. The electronic musical instrument system according to claim 1, wherein said musical effect imparting circuit means includes first and second musical effect imparting circuits; and further comprising means for selectively coupling said first and second musical effect imparting circuits to said sound system in response to operation of said musical tone signal selection means.

3. The electronic musical instrument system according to claim 1, wherein said musical effect imparting circuit means includes means for modulating musical tone signals; and wherein said control means includes frequency variable oscillator means for supplying a modulation signal to said modulating means which has a frequency depending on a musical effect selected by said musical effect selection means.

4. The electronic musical instrument system according to claim 1, which further comprises respective level controllers provided at said inputs of said musical effect imparting circuit means and said sound system, said level controllers being ganged with each other.

5. The electronic musical instrument system according to claim 1, wherein said sound system includes first and second sound channels each including at least one loudspeaker; said musical effect imparting circuit means includes first and second modulators respectively coupled to said respective first and second sound channels and a third modulator commonly coupled to said first and second sound channels; and said control means includes first means for producing and coupling to said respective first and second modulators two modulation signals at a first frequency and 120 degrees out of phase with each other and second means for producing and coupling to said third modulator a further modulation signal at a second frequency which is substantially two times said first frequency.

6. The electronic musical instrument system according to claim 5, wherein said first and second modulators are phase modulators, and said third modulator is a delay-time modulator.

7. The electronic musical instrument system according to claim 5, wherein said musical effect imparting circuit means further comprises a filter circuit coupling said third modulator to said first and second sound channels.

8. The electronic musical instrument system according to claim 1, wherein said musical effect imparting means includes modulator means for modulating musical tone signals; and said control means includes frequency variable oscillator means adapted to be set to produce modulation signals of different frequencies in accordance with respective selection states of said musical effect selection means; and further comprising player operable means for continuously varying the oscillation frequency of said oscillator means.

9. The electronic musical instrument system according to claim 1, wherein said musical effect imparting means includes modulator means for modulating musical tone signals; and said control means includes frequency variable oscillator means for producing modulation signals of different frequencies in accordance with selection states of said musical effect selection means; and further comprising a filter circuit connected between said frequency variable oscillator means and said modulator means.

10. The electronic musical instrument system according to claim 9, wherein said filter circuit is a lowpass filter.

11. The electronic musical effect imparting system according to claim 1, wherein said musical tone signal selection means has a second output terminal at which appears a musical tone signal not appearing at said one output terminal thereof, and further comprising means for coupling said second output terminal to said sound system without passing through said musical effect imparting circuit means.

12. The electronic musical instrument system according to claim 11, which further includes a second sound system coupled to said second output terminal.

13. The electronic musical instrument system according to claim 1, wherein said sound system includes a mid-range loudspeaker and a high-range loudspeaker.

14. The electronic musical instrument system according to claim 12, wherein said second sound system includes a low-range loudspeaker.

* * * * *